US005099217A

United States Patent [19]

Leupold

[11] Patent Number: 5,099,217

[45] Date of Patent: Mar. 24, 1992

[54] CONSTANT GAP CLADDED TWISTER

[75] Inventor: Herbert A. Leupold, Eatontown, N.J.

[73] Assignee: The United States of America as represented by the Secretary of the Army, Washington, D.C.

[21] Appl. No.: 760,644

[22] Filed: Sep. 16, 1991

[51] Int. Cl.[5] ..... H01F 7/02

[52] U.S. Cl. ..... 335/306; 335/304; 335/210; 335/211; 335/214; 315/5.35

[58] Field of Search ..... 335/210, 211, 212, 214, 335/296, 297, 298, 301-306; 315/5.34, 5.35; 250/396 ML

[56] References Cited

U.S. PATENT DOCUMENTS

| | | | |
|---|---|---|---|
| 4,654,618 | 3/1987 | Leupold | 335/304 |
| 4,658,228 | 4/1987 | Leupold | 335/211 |
| 4,764,743 | 8/1988 | Leupold | 335/306 |

OTHER PUBLICATIONS

A. B. C. Morcos, E. Potenziani, II, Herbert A. Leupold, "Permanent-Magnet Structures for the Production of Transverse Helical Fields", IEEE Transactions on Magnetics, vol. MAG-22, No. 5, pp. 1066-1068, Sep. 1986.

*Primary Examiner*—Leo P. Picard
*Assistant Examiner*—Ramon M. Barrera
*Attorney, Agent, or Firm*—Michael Zelenka; William H. Anderson

[57] ABSTRACT

A cladded magnet twister device for a microwave/millimeter wave source is comprised of a plurality of polygonal similarly magnetized magnet segments. Each magnet segment is displaced radially in equal angular segments along the central axis relative to its neighboring segment to provide a transverse helical field and is comprised of a relatively short length of an array of bar magnets, cladding magnets, bucking magnets, pole pieces and corner pieces. The pole pieces are secured to the ends of the bar magnets and have convex faces which are directed inwardly toward one another.

15 Claims, 2 Drawing Sheets

FIG. 1
PRIOR ART
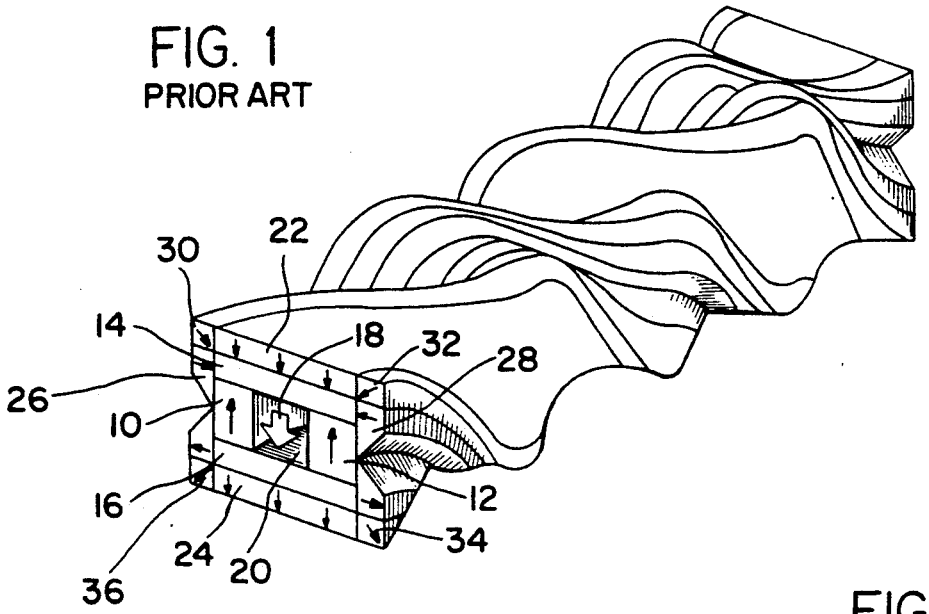
FIG. 2
PRIOR ART
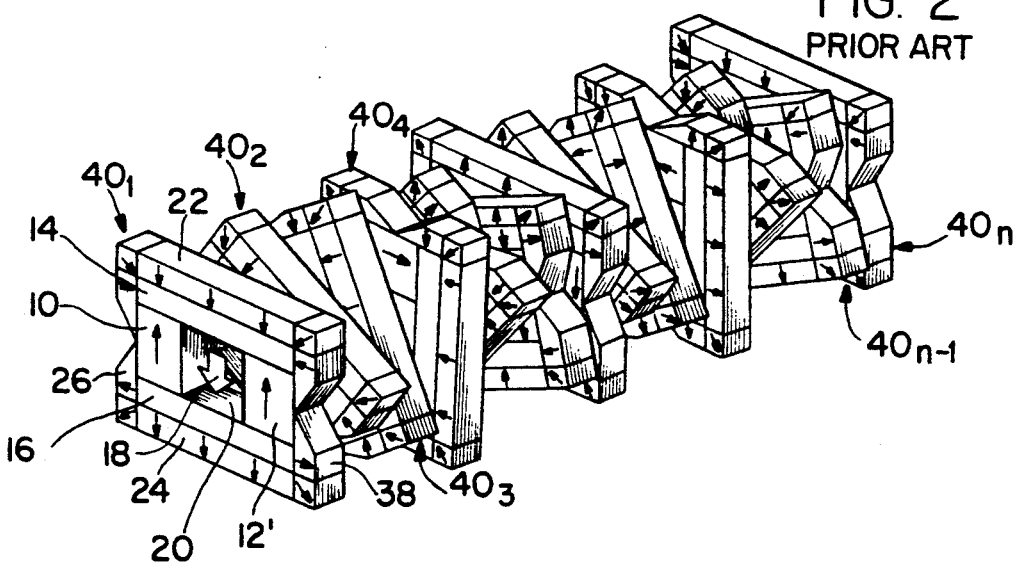
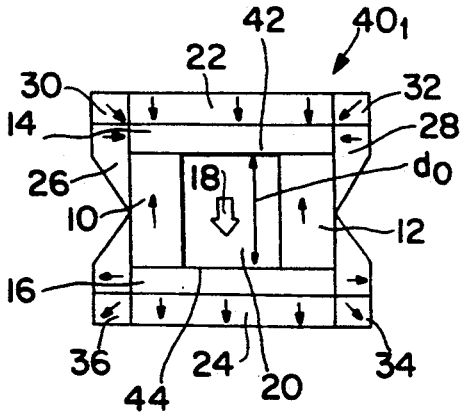
FIG. 3
PRIOR ART FIG. 4
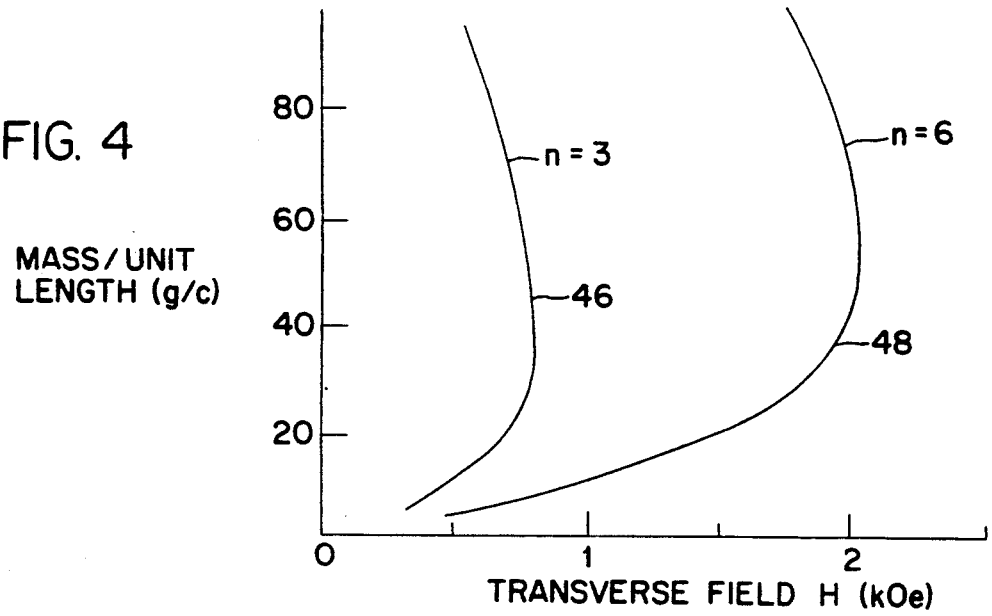
FIG. 5
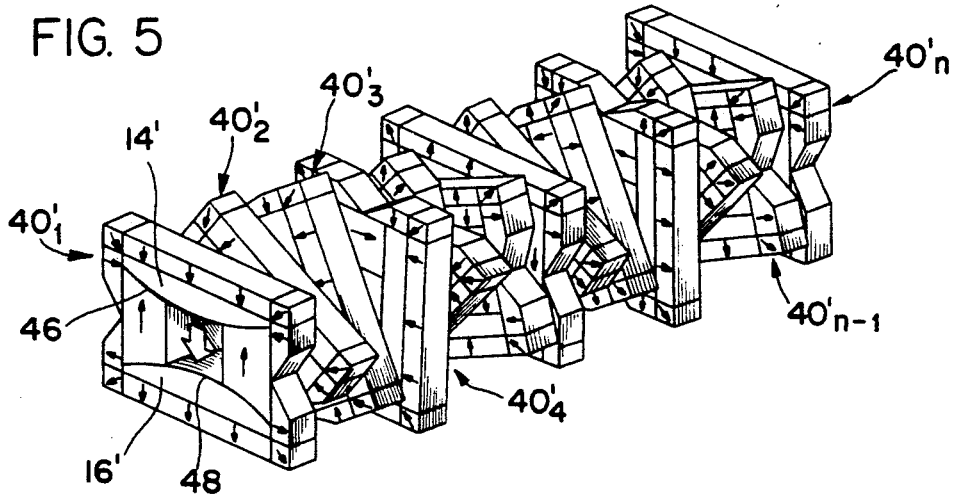
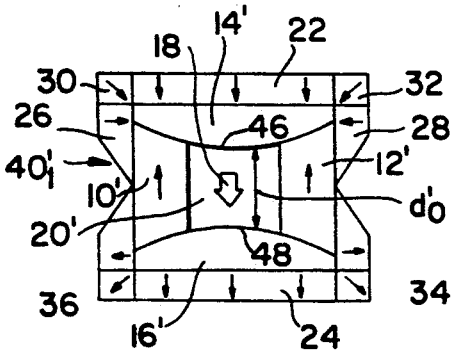
FIG. 6
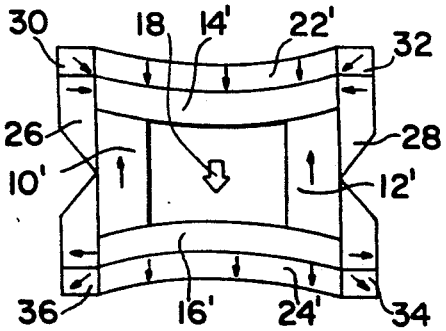
FIG. 7

CONSTANT GAP CLADDED TWISTER

GOVERNMENT INTEREST

The invention described herein may be manufactured, used, and licensed by or for the Government of the United States of America for governmental purposes without the payment to me of any royalty thereon.

BACKGROUND OF THE INVENTION

The invention relates generally to permanent magnet structures which are used in the generation of electromagnetic energy, and more particularly to a permanent magnet structure for producing a helically oriented transverse magnetic field in a microwave/millimeter wave radiation source such as a free electron laser.

The utilization of high power, broad-band radiation sources for microwave and millimeter wave apparatus such as radar is improved by the availability and inclusion of helical undulator or twister design magnetic field generators. The concept of using permanent magnet rare earth compound materials designed and arranged in a specific manner for producing a desired helical or twisted field without the need for large and bulky ferrite magnets and/or electromagnetic elements is generally known, having been disclosed, for example, in U.S. Pat. No. 4,654,618, Mar. 31, 1987; U.S. Pat. No. 4,658,228, April 14, 1987; and U.S. Pat. No. 4,764,743, Aug. 16, 1988. The teachings and methods which are described in these patents, moreover, are specifically incorporated herein by reference. The latter patent is particularly pertinent because it discloses a cladded magnet structure from which the present invention derives.

SUMMARY

It is a primary object of this invention, therefore, to provide an improvement in permanent magnet structures utilized in microwave or millimeter wave energy sources.

It is another object of the present invention to provide an improvement in permanent magnet structures comprised of rare earth compound materials which generate helically defined magnetic fields in microwave or millimeter wave radiation sources.

It is a further object of the invention to provide an improvement in cladded magnetic structures which generate helically defined magnetic fields in circularly polarized microwave or millimeter wave sources such as a free electron laser.

The foregoing and other objects are achieved by a cladded magnet twister device comprised of a plurality of polygonal similarly magnetized magnet segments, each having a generally centrally located opening therethrough, arranged concentrically on a central longitudinal axis with said openings in substantial registration along the axis to define an elongated axial passage of a microwave/millimeter wave energy source. Each magnet segment is displaced azimuthally in equal angular segments along the central axis relative to its neighboring segment to provide a transverse helical field and is comprised of a relatively short length of an array of bar magnets, cladding magnets, bucking magnets, pole pieces and corner pieces, with the improvement comprising a pair of opposing pole pieces secured to the ends of the bar magnets and having convex faces which are directed inwardly toward one another. Such an arrangement of components improves the field strength and uniformity of the transverse field, resulting in a structure which extends the maximum field strength to levels heretofore unattainable in cladded twisters.

BRIEF DESCRIPTION OF THE DRAWINGS

The following detailed description will be more readily understood when considered together with the accompanying drawings in which:

FIG. 1 is a perspective view of an ideal permanent magnet twister structure in accordance with the known prior art;

FIG. 2 is a perspective view of an actual cladded magnet twister structure in accordance with the known prior art;

FIG. 3 is a front planar view illustrative of one of the cladded magnet segments shown in FIG. 2;

FIG. 4 is a set of characteristic curves helpful in understanding the operation of the subject invention;

FIG. 5 is a perspective view illustrative of the preferred embodiment of the invention;

FIG. 6 is a front planar view of one of the permanent magnet twister structures shown in FIG. 5; and FIG. 7 is a front planar view of a modified form of the twister section shown in FIG. 6.

DETAILED DESCRIPTION OF THE INVENTION

Prior to considering the preferred embodiment of the invention, reference will first be made to the prior art structures shown in FIGS. 1 and 2. These structures are disclosed in more specific detail in the above-referenced U.S. Pat. No. 4,764,743, and which is entitled, "Permanent Magnet Structures For The Production Of Transverse Helical Fields" by Herbert A. Leupold et al and can be referred to for more background information if desired.

FIG. 1 discloses an ideal cladded magnet twister structure comprised of a pair of longitudinally extending main flux carrying magnets 10 and 12 and a pair of orthogonally oriented pole pieces 14 and 16 which are affixed to the magnets 10 and 12. These elements provide the major flux field 18 in a generally rectangular central opening 20 and provide a closed path for an electron beam comprising a free electron laser source of circularly polarized radiation. Coextending longitudinally with the main magnets 10 and 12 and the pole pieces 14 and 16 are a pair of bucking magnets 22 and 24, which are contiguous to the pole pieces 14 and 16, respectively, and a pair of cladding magnets 26 and 28 having pinched-in mid portions in the form of V shaped notches and which are disposed adjacent the pole pieces 10 and 12. Four corner pieces 30, 32, 34, 36 are contiguous to the ends of the bucking magnets and the cladding magnets, and may be rectangular or triangular in shape, as desired.

The practical attainment of the idealized twister structure shown in FIG. 1 is realized by the structure shown in FIG. 2 comprising a plurality of identical equal width magnet segments $\mathbf{40}_1$, $\mathbf{40}_2$, ... $\mathbf{40}_{n-1}$, $\mathbf{40}_n$, which abut one another along a common central longitudinal axis. Each of the segments $\mathbf{40}_1$ ... $\mathbf{40}_n$ are fabricated from rare earth compound materials and are rotated about the central longitudinal axis in successively equal angular amounts so as to produce a helically varying or twisted field 18 through the passage 20. As shown, a 90° rotation of the transverse field 18 is produced in a span of four segments $40_1$-$40_4$.

Ideally, the pole pieces 14 and 16 of each segment $40_1$, for example, form equally potential surfaces 42 and 44 as shown in FIG. 3, between which the desired magnetic flux lines of the transverse magnetic field 18 extend. The normal nearest distance d between surfaces 42 and 44 becomes smaller as one moves from the central longitudinal axis and which varies according to the expression:

$$d = \frac{d_0}{\sqrt{1 + x^2p^2}} \quad (1)$$

where $d_0$ is the distance between the pole pieces 14 and 16 at the axis transverse field plane (x,y) and x is the normal distance from the y, z plane and p is the pitch of the helical twist.

Because the distance d is shorter where the supply magnets 10 and 12 are located, any attempt to increase the transverse field 18 by the use of wider supply magnets 10 and 12 results in an increased shorting out of the flux at the periphery of the structure. A point is be reached sufficiently far from the central longitudinal axis where any further increase in magnet width results in a flux shorting that is greater than the additional amount produced by the enlarged magnets and the field 18 begins to decrease with structural width and mass. This is illustrated by the two curves 46 and 48 for structures having twists of $n = 3$ and $n = 6$, respectively, where $n = \lambda/b$, where $\lambda$ is the period length of the helix and b is proportional to the width distance between the main magnets 10 and 12.

This now leads to a consideration of the preferred embodiment of the invention which consists in providing a means for compensating for any narrowing of the twisted structure toward the outer edges and comprises replacing the rectangular pole pieces 14 and 16 as shown in FIGS. 1–3, with pole pieces 14' and 16' as shown in FIGS. 5 and 6. These pole pieces are comprised of plano-convex members including a pair of mutually opposing convex surfaces 46 and 48 which are separated by a distance $d'_0$ which varies in width from the center, i.e. longitudinal axis, as:

$$d'_0 = d_0\sqrt{1 + x^2p^2} \quad (2)$$

When the term $d'_0$ is inserted in equation (1) for $d_0$, an equality of $d = d_0$ is obtained, which is a desired constant width.

Now part of the flux of each additional magnet increment will be furnished to the working space 20 (FIG. 6) and the excessive leakage of flux laterally through the magnets 10' and 12' is reduced to values below the total flux furnished thereby. Thus the arrangement shown in Figures extends the maximum fields attainable in cladded twisters to higher values than presently attainable.

Also in accordance with the present invention and as illustrated in FIG. 7, both the bucking magnets 22' and 24' may be contiguous with an outer concave surface of pole pieces 14' and 16'. With such a configuration, the weight of the entire structure may be further reduced. However, those skilled in the art will appreciate that when using such a configuration the average length of the pole pieces and bucking magnets must be considered in the design considerations.

Having thus shown and described what is at present considered to be the preferred embodiment of the invention, it should be noted that the same has been made by way of illustration and not limitation. Accordingly, all modifications, alterations and changes coming within the spirit and scope of the invention as defined in the appended claims are herein meant to be included.

What is claimed is:

1. A constant gap cladded twister for producing a helically oriented magnetic field comprising:

a plurality of like permanent magnet segments centered on a common central longitudinal axis, each said segment, moreover, being rotated azimuthally in generally equal annular steps with respect to their adjacent segment about said axis, and wherein each segment is further comprised of, a pair of bar magnets separated by a predetermined lateral distance, a pair of pole pieces spanning said bar magnets, a pair of bucking magnets adjacent to said pole pieces, and a pair of cladding magnets adjacent said bar magnets and said pole pieces, said pole pieces further have mutually inner convex faces, whereby magnetic flux produced by said bar magnets is substantially uniform across a space defined by said bar magnets and said pole pieces.

2. The cladded twister according to claim 1 and additionally including magnetic corner pieces located adjacent said pair of cladding magnets and said pair of bucking magnets.

3. The cladded twister according to claim 2 wherein said corner pieces are comprised of generally rectangular blocks contiguous with respective ends of said bucking magnets and said cladding magnets.

4. The cladded twister according to claim 2 wherein said corner pieces are comprised of generally triangular blocks contiguous with respective ends of said bucking magnets and said cladding magnets.

5. The cladded twister according to claim 2 wherein said magnet segments are comprised of rare earth compound material.

6. The cladded twister according to claim 2 wherein said bar magnets include curvilinear end surfaces contiguous with said convex faces of said pole pieces and mutually opposing parallel inner side surfaces.

7. The cladded twister according to claim 2 wherein said pair of cladding magnets include respective reduced thickness regions intermediate their length.

8. The cladded twister according to claim 2 wherein said cladding magnets respectively include reduced thickness regions midway along their length.

9. The cladded twister according to claim 8 wherein said reduced thickness regions comprise V-shaped notches in the outer surface of said cladding magnets.

10. The cladded twister according to claim 2 wherein said bucking magnets comprise a pair of magnets coextensive with the length of said pole pieces.

11. The cladded twister according to claim 10 wherein said pair of bucking magnets are substantially rectangular in cross section.

12. The cladded twister according to claim 1 wherein said segments comprise a plurality of segments of substantially equal thickness in a longitudinal direction along said central axis.

13. The cladded twister according to claim 1 wherein the space defined by said pair of bar magnets and said pair of pole pieces comprises a pair of opposing parallel sides and a pair of inwardly facing curvilinear sides.

14. The cladded twister according to claim 1 wherein said pole pieces include concave outer surfaces.

15. The cladded twister according to claim 14 wherein said bucking magnets include concave outer surface and convex inner surfaces contiguous to the respective pole pieces.

* * * * *